United States Patent [19]

Wendt

[11] Patent Number: 4,638,606

[45] Date of Patent: Jan. 27, 1987

[54] DECORATIVE TRIM SYSTEM FOR PARTITION ADAPTED TO SUPPORT A CANTILEVERED LOAD

[75] Inventor: Alan C. Wendt, Barrington, Ill.

[73] Assignee: United States Gypsum Company, Chicago, Ill.

[21] Appl. No.: 773,785

[22] Filed: Sep. 9, 1985

Related U.S. Application Data

[63] Continuation-in-part of Ser. No. 551,424, Nov. 14, 1983, Pat. No. 4,570,390.

[51] Int. Cl.[4] ..... E04B 1/56

[52] U.S. Cl. ..... 52/36; 52/275; 52/282; 52/718.1; 248/243; 211/90; 211/190

[58] Field of Search ..... 52/36, 729, 282, 281, 52/275, 285, 732, 739, 717, 718; 248/235, 224.4, 243; 211/90, 190, 207

[56] References Cited

U.S. PATENT DOCUMENTS

| | | | |
|---|---|---|---|
| 1,789,827 | 1/1931 | McKay . | |
| 2,065,920 | 12/1936 | Clark | 52/275 |
| 3,010,547 | 11/1961 | Foster | 52/281 |
| 3,203,151 | 8/1965 | Bransford, Jr. | 52/729 |
| 3,394,507 | 7/1968 | Doke | 52/36 |
| 3,407,547 | 10/1968 | Doke et al. | 52/729 |
| 3,566,561 | 3/1971 | Tozer | 52/729 |
| 3,648,419 | 3/1972 | Marks | 52/36 |
| 3,730,477 | 5/1973 | Wavrunek | 52/36 |
| 3,774,344 | 11/1973 | Symons | 52/732 |
| 3,778,939 | 12/1973 | Nelsson | 52/36 |
| 3,782,048 | 1/1974 | Corman | 52/282 |
| 3,810,340 | 5/1974 | Nelsson | 52/729 |
| 3,828,495 | 8/1974 | Law | 52/36 |
| 4,086,739 | 5/1978 | Hall | 52/281 |
| 4,231,197 | 11/1980 | Caplan et al. | 52/36 |
| 4,441,300 | 4/1984 | Varon et al. | 52/732 |
| 4,443,979 | 4/1984 | Varon et al. | 52/36 |
| 4,570,390 | 2/1986 | Wendt | 52/36 |

OTHER PUBLICATIONS

Sweet's Catalog, 1979, Sec. 9.1/Ce.

*Primary Examiner*—William F. Pate, III
*Assistant Examiner*—Cardine D. Dennison
*Attorney, Agent, or Firm*—Robert M. Didrick; Samuel Kurlandsky; Robert H. Robinson

[57] ABSTRACT

The outside corners of hollow partitions comprising kerfed-edge wallboards supported by kerf-engaging studs having a bifurcated web open to the frontal insertion of a slotted standard from which furniture may be suspended are supported by a corner stud fastened to the bifurcated stud. The corner stud has an integral kerf-engaging finger or, alternatively, an attached kerf-engaging spline. Decorative trim for the outside corner is fastened to a longitudinal channel housing on the corner stud.

12 Claims, 4 Drawing Figures

DECORATIVE TRIM SYSTEM FOR PARTITION ADAPTED TO SUPPORT A CANTILEVERED LOAD

This application is a continuation-in-part of my copending application Ser. No. 551,424, now U.S. Pat. No. 4,570,390, which was filed on Nov. 14, 1983.

Said copending application is directed to a drywall construction system comprising kerfed-edge wallboards and studs having kerf-engaging flanges and a two-tiered channel within a bifurcated web which is open to the frontal insertion and attachment of a slotted standard from which furniture and the like may be suspended. This application is directed to a system for mounting decorative trim at the outside corners of hollow partitions comprising such studs and wallboards.

Conventional drywall construction systems provide for the mounting of shelves and heavy articles such as furniture on wallboard partitions by means of brackets inserted into slotted standards fastened to studs in the partitions. It is desirable that such systems be strong, adjustable, inexpensive, simple to install, and inconspicuous when not being employed to support such articles.

Attempts have been made in the past to provide mounting systems having one or more of such desirable attributes. In U.S. Pat. No. 3,394,507, Doke teaches a stud having laterally opposed flanges flanking a channel. A slotted standard is attached to the flanges so that the slots open into the channel. Wallboard is fastened to the flanges with screws. Thus, a standard must be placed within a stud at every location where a shelf may be desirable in the future before the wallboard is placed into position. Failing that, the partition would have to be dismantled to insert the standards whenever relocation of shelves is desired. Also, the slots of adjacent standards must be carefully aligned before the standards are fastened so that the shelves or other objects will be level when mounted.

Nelsson teaches an integral stud and standard in U.S. Pat. Nos. 3,778,939 and 3,818,340. Such studs must be carefully measured and installed in order to align the slots of adjacent studs.

The purpose for the kerfed edges on the wallboard is to allow for attachment of the board to the framework that is not visible once the partition is completed. This is especially desirable when the wallboard has been pre-decorated. Vinyl laminated wallboard is often used in the construction of relocatable office partitions. A problem arises, however, in bracing the free ends of the wallboards at the outside corners and connecting them to the framework of the partition. The connectors should also be hidden from view. It is desirable to have a system whereby outside corner trim pieces may be easily mounted on and demounted from the partition.

It is an object of this invention to provide a system for the construction of drywall partitions on which shelves and heavy objects may be mounted.

It is another object of this invention to provide a system for mounting heavy objects on drywall partitions which is inexpensive, simple to install, and inconpicuous when not being so employed.

It is another object of this invention to provide a stud for drywall construction which allows virtually unlimited adjustment of a slotted standard up and down the length of the stud after the wallboard has been affixed to the stud.

It is a further object of this invention to provide a system for mounting decorative trim at the outside corners of kerfed-edge wallboard partitions adapted to support a cantilevered load.

It is a related object to provide a system for bracing the free ends of such wallboards and connecting those ends to the framework of such partitions.

It is a still further object of this invention to provide a system for mounting heavy objects on drywall partitions which does not require the drilling of holes in the stud components of the partition to accommodate fasteners for the slotted standards.

These and other objects which will be apparent from the drawings and the following description are achieved by the partition system of this invention which utilizes, in combination:

a stud having a web which comprises a plate portion and a bifurcated channel housing for a two-tiered channel, the first tier being proximate to the plate and having confronting threaded or threadable facets so that the channel may accept a screw at any level, the second tier being open to the frontal insertion of a slotted standard, said stud also having a flange extending laterally from the housing of the first tier; and a corner stud having a first flange fastened to the plate of the bifurcated stud, and a web having a first segment extending at a right angle from said flange, a second segment extending at a right angle from the first in opposition to said flange, a third segment offset from but in a plane parallel to the first segment, a fourth segment extending at a right angle from the third segment and through the plane of the first segment, a fifth segment at a right angle to the fourth segment and extending toward the plane of the second segment, a sixth segment at a right angle to the fifth segment and extending away from the plane of the third segment, a second flange extending at a right angle to the sixth segment toward the plane of the first flange, and a channel housing opening outwardly from the juncture of the third and fourth segments and diagonally disposed with respect to said segments; and means for fastening wallboard to the corner stud.

As will be seen, the inside corners of the partitions described herein have bifurcated studs whose channel housings abut the edge of only one wallboard each. There is a need in such constructions for only one flange extending from the channel housing to engage the wall-board kerf but it is simpler and more economical from the standpoint of inventory costs to make all of the bifurcated studs with two such flanges in opposing relation because the bifurcated stud will more often be used to support wallboards abutting both sides of the channel housing. The flanges and the channel of the bifurcated stud are symmetrical about the centerline of the plate portion of the web. A pair of flanges in this context means one or more pairs of flanges. The screw may be any threaded fastener such as a wood screw, machine screw, bolt, selftapping sheet metal screw, or the like. Thus, the threaded facets may be tapered to conform to a wood screw or they may be parallel.

The bifurcated studs of Ser. No. 551,424, now U.S. Pat. No. 4,570,390, may be interspersed in the interconnecting framework of studs and runners commonly used in a partition but in this invention their particular use is in combination with the corner stud whereby each helps to brace the other and the combination provides support for the wallboards and trim pieces at an outside corner of a partition. A pair of the bifurcated studs, often but not necessarily consecutively placed, are required for the proper support of long shelves which rest on brackets projecting out from the wall. The use of one such stud is contemplated, however, where the load is concentrated along the centerline of a projecting bracket such as a coat rack or the fulcrum of a child's teeter-totter in a day care center. Even in such a case, that one bifurcated stud may be a member in the framework for an outside corner according to this invention.

Thus, the partition of this invention comprises a bifurcated stud as a first member of the outside corner framework, a corner stud fastened as a second member to said bifurcated stud, and a third member, which may or may not be a bifurcated stud, fastened to the corner stud to stand at an angle to the vertical plane of the first member. The partition further comprises wallboards disposed about the framework and fastened by kerf engagement or otherwise, as appropriate, to the various members of the framework. The bifurcated studs are adapted to the mounting of furniture or shelves with brackets at the inside corner or the outside corner by the fastening of the requisite number of slotted standards to the bifurcated channel housings of said studs.

Turning now to the drawings.

Figure 1:
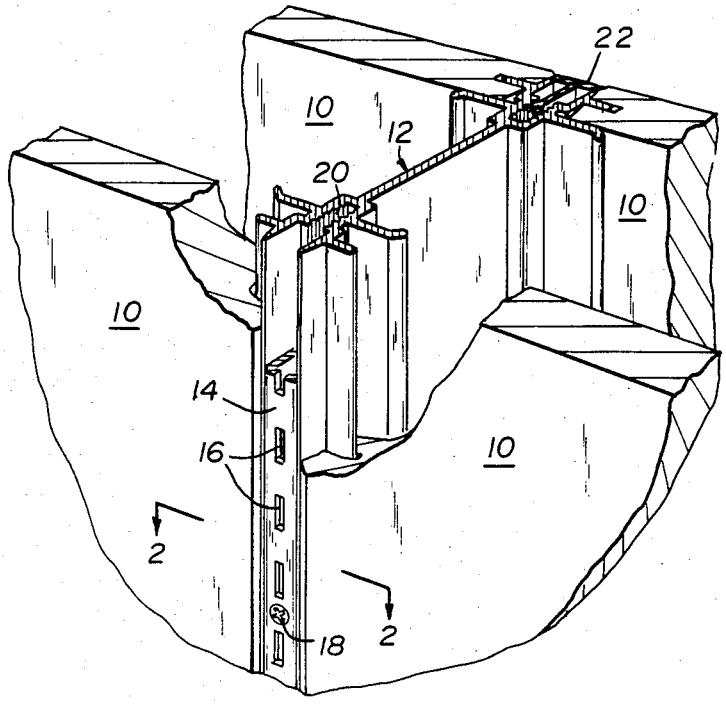
FIG. 1 is a perspective view, partially cut away, of a preferred embodiment of the invention of co-pending application Ser. No. 551,424.

In FIG. 1, the panels 10 are held upright by the extruded aluminum stud 12, and the shelf standard 14, having a column of slots 16, is fastened to the stud 12 by a plurality of screws 18 turned into the threaded channel 20. A filler trim piece 22 is pressed into place where a standard 14 is not required.

Figure 2:
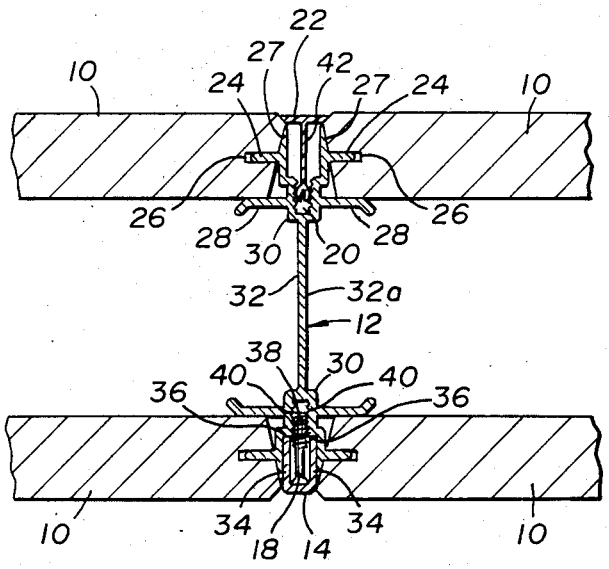
FIG. 2 is a sectional view of the partition system of FIG. 1, taken along line 2—2.

In FIG. 2, the panels 10 are attached to the stud 12 by the insertion of the opposing kerf flanges 24 into the kerfs 26 and the panels 10 are spaced apart by the stops 27 and braced by the opposing buttress flanges 28. The flanges 24 extend laterally from their respective stops 27 and the flanges 28 likewise extend laterally from the channel housings 30 which are U-shaped extensions of the web 32. The web 32 comprises the housing portions 30 and the plate portion **32*a*. The legs 34 of the slotted standard 14 are forced against the ledges 36 of the housings 30 by the engagement of the screw 18 with the threads 38 on the opposing interior walls 40 of the channel housing 30. The trim piece 22, which may be made of a vinyl plastic or other deformable material, is held in place by an anchor leg 42 which fits snugly within the threaded channel 20**.

Figure 3:
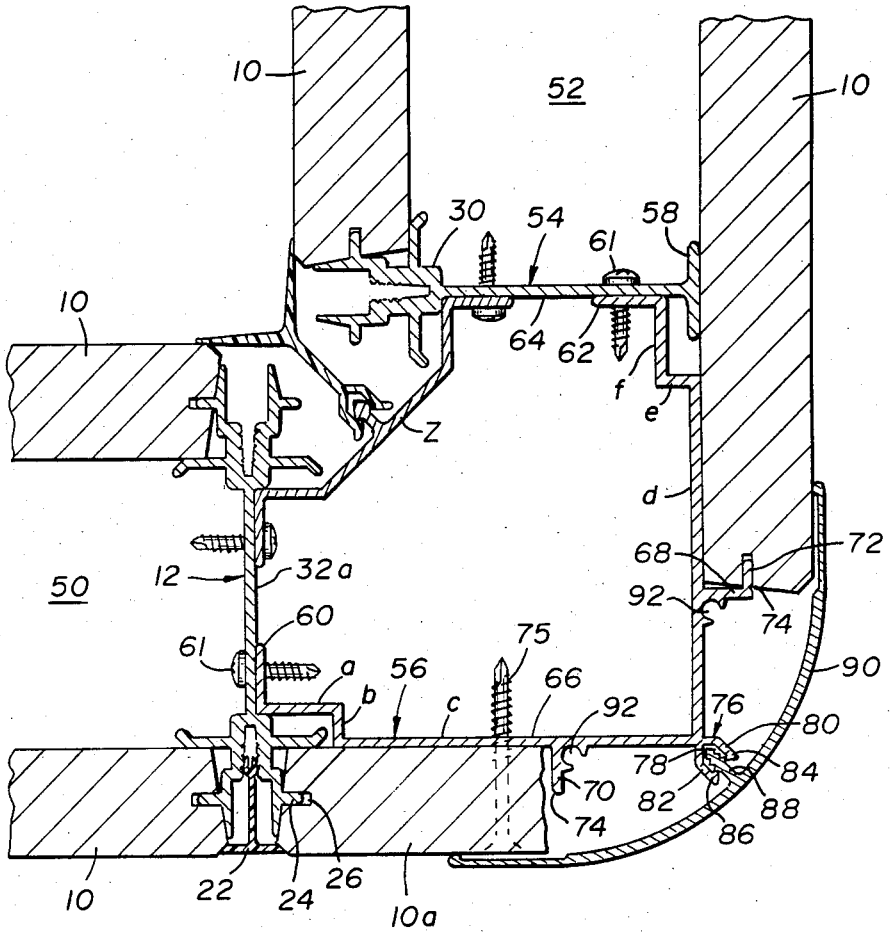
FIG. 3 is a sectional view of a partition system of this invention.

In FIG. 3, the framework for an outside corner of the intersecting partitions 50 and 52 is made up of the stud 12, the stud 54, and the corner stud 56. The inside corner of the partitions is stabilized by the tying stud Z which is not part of this invention but is disclosed and claimed in my co-pending application Ser. No. 734,677, which was filed May 16, 1985. The stud 54 is similar to the stud 12 except that one of the channel housings 30 is replaced by the T-shaped flange 58. The flange 60 of the corner stud 56 is fastened to the plate **32*a* of the stud 12 by the screw 61 and others like it along the length of the two studs and the flange 62 of the stud 56 is fastened to the plate 64 of the stud 54 in like manner. The web 66 of the stud 56 comprises segments a, b, c, d, e, and f which are disposed at right angles to their neighbors. Extending from segments 66*c* and 66*d*, respectively, are the spurs 68 and 70 from which the kerf-engaging fingers 72 project. The fingers 72 may be broken off at the grooves 74 in the event that the kerfed edge of a panel 10 has to be cut off to make the panel fit into the corner such as is shown in the case of panel 10*a*. A panel having no kerf in its cut edge such as panel 10*a* is fastened to the corner stud 56 by the screw 75 and others like it as well as being attached to the stud 12 by the insertion of the kerf flange 24 into the kerf 26. At the juncture of the web segments 66*c* and 66*d* the keeper 76 has a longitudinal channel 78 between the walls 80 and 82 which terminate at the lips 84 and 86 which retain the serrated tongue 88 of the trim piece 90. Another function of the keeper 76 is to receive a screw which fastens a ceiling runner (not shown) to the corner stud 56. The collets 92** also receive such a screw.

Figure 4:
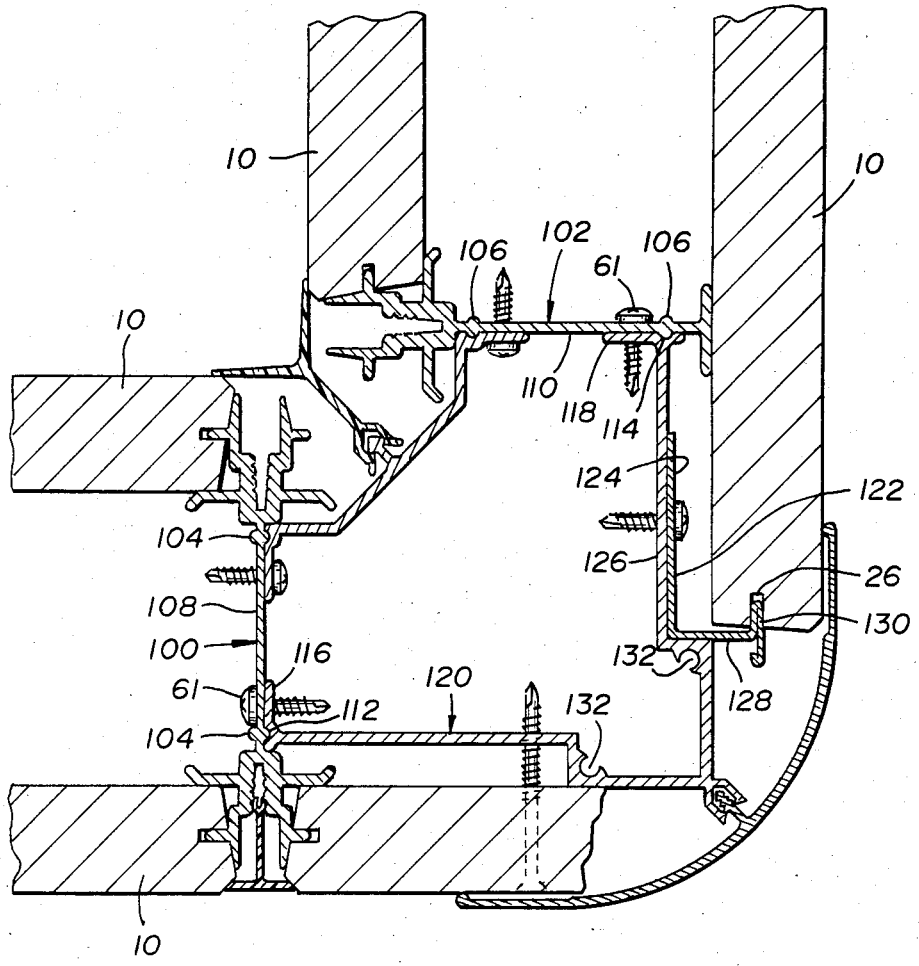
FIG. 4 is a sectional view of another embodiment of the partition system of this invention.

In FIG. 4, the studs 100 and 102 are similar to the studs 12 and 54 of FIG. 3 except for the longitudinal beads 104 and 106 which protrude from the plates 108 and 110, respectively. The beads 104 and 106 cooperate with the longitudinal grooves 112 and 114 in the flanges 116 and 118 of the corner stud 120 to lock the corner stud in place before it is fastened with the screws 61. The beads and grooves may, of course, be interchanged. The corner stud 120 does not have the integral kerf engaging fingers 72 and 74 of the stud 56 in FIG. 3 but the furring strip 122 is an alternative kerf-engaging means for the system of this invention. The leg 124 of the strip 122 is fastened to the web 126 of the stud 120 and the leg 128 projects beyond the stud 120 and is bent so that the spline 130 engages the kerf 26 of the panel 10. The function of the collets 132 is the same as that of collets 92 in FIG. 3.

The furring strip 122 is preferably made of steel and the studs 12, 54, 56, 100, 102, and 120 are preferably made by the extrusion of aluminum.

While particular embodiments of this invention have been described, it will be understood that the invention may be modified within the spirit and scope of the appended claims.

The subject matter claimed is:

1. A system for forming an outside corner of a kerfed-edge wallboard partition adapted to support a contilevered load, and for mounting decorative trim at said corner, said system comprising:

a stud having a web which comprises a plate portion and a bifurcated channel housing for a two-tiered longitudinal channel, the first tier being proximate to the plate and having confronting threaded or threadable facets so that the channel may accept a screw at any level, the second tier being open to the frontal insertion of a slotted standard, said stud also having a kerf-engaging flange extending laterally from the housing of the second tier; and a corner stud having a first flange fastened to the plate of the bifurcated stud, a web having a first segment extending at a right angle from said flange, a second segment extending at a right angle from the first segment in opposition to said flange, a third segment offset from but in a plane parallel to the first segment, a fourth segment extending at a right angle from the third segment and through the plane of the first segment, a fifth segment at a right angle to the fourth segment and extending toward the plane of the second segment, a sixth segment at a right angle to the fifth segment and extending away from the plane of the third segment, a second flange extending at a right angle from the sixth segment toward the plane of the first flange, and a channel housing opening outwardly from the juncture of the third and fourth segments and diagonally disposed with respect to said segments; and means for fastening wallboard to the corner stud.

2. The system of claim 1 wherein the means for fastening wallboard to the corner stud is a kerf-engaging finger integral with said stud and connected to the web thereof.

3. The system of claim 1 wherein the means for fastening wallboard to the corner stud is a furring strip having a leg fastened to the web of the corner stud and a kerf-engaging spline connected to the leg.

4. The system of claim 1 wherein a longitudinal bead protrudes from the plate of the bifurcated stud and the first flange of the corner stud has a longitudinal groove into which said bead fits.

5. A partition having an outside corner and adapted to support a cantilevered load, said partition comprising:

a stud having a web which comprises a plate portion and a bifurcated channel housing for a two-tiered longitudinal channel, the first tier being proximate to the plate and having confronting facets so that the channel may accept a screw at any level, the second tier being open to the frontal insertion of a slotted standard, said stud also having a kerf-engaging flange extending laterally from the housing of the second tier;

a corner stud having a first flange fastened to the plate of the bifurcated stud, a web having a first segment extending at a right angle from said flange, a second segment extending at a right angle from the first segment in opposition to said flange, a third segment offset from but in a plane parallel to the first segment, a fourth segment extending at a right angle from the third segment and through the plane of the first segment, a fifth segment at a right angle to the fourth segment and extending toward the plane of the second segment, a sixth segment at a right angle to the fifth segment and extending away from the plane of the third segment, a second flange extending at a right angle to the sixth segment toward the plane of the first flange, and a channel housing opening outwardly from the juncture of the third and fourth segments and diagonally disposed with respect to said segments;

said bifurcated stud and corner stud constituting first and second upright members of the outside corner of the partition;

a third upright member fastened to the second flange of the corner stud; and a plurality of kerfed-edge wallboards fastened to the upright members.

6. The partition of claim 5 further comprising a trim piece fastened to the channel housing of the corner stud.

7. The partition of claim 5 further comprising means associated with the corner stud for engaging a kerf in a wallboard.

8. The partition of claim 7 wherein the kerf-engaging means is a finger integral with the corner stud and connected to the web thereof.

9. The partition of claim 7 wherein the kerf-engaging means is a furring strip having a leg fastened to the web of the corner stud and a kerf-engaging spline connected to the leg.

10. The partition of claim 5 wherein the first and third members are bifurcated studs.

11. The partition of claim 5 wherein a longitudinal bead protrudes from the plate of the bifurcated stud and the first flange of the corner stud has a longitudinal groove into which said bead fits.

12. The partition of claim 5 wherein wallboards abut the fourth and fifth segments of the corner stud web.

* * * * *